United States Patent [19]

Paspek

[11] Patent Number: 4,670,019

[45] Date of Patent: Jun. 2, 1987

[54] STABILIZATION OF COAL-OIL-WATER MIXTURES

[75] Inventor: Stephen C. Paspek, North Royalton, Ohio

[73] Assignee: The Standard Oil Company, Cleveland, Ohio

[21] Appl. No.: 378,376

[22] Filed: May 14, 1982

[51] Int. Cl.[4] ..... C10L 1/32

[52] U.S. Cl. ..... 44/51; 44/67; 44/68

[58] Field of Search ..... 44/51, 67, 68, 76

[56] References Cited

U.S. PATENT DOCUMENTS

| | | | |
|---|---|---|---|
| 4,149,855 | 4/1979 | Kohn et al. | 44/51 |
| 4,177,039 | 12/1979 | Sakuma et al. | 44/51 |
| 4,203,729 | 5/1980 | Ishizaki et al. | 44/51 |
| 4,251,229 | 2/1981 | Naka et al. | 44/51 |
| 4,282,006 | 8/1981 | Funk | 44/51 |
| 4,355,999 | 10/1982 | Masologites | 44/1 SR |
| 4,448,584 | 5/1984 | Masologites et al. | 44/1 SR |
| 4,448,585 | 5/1984 | Yoo | 44/51 |

OTHER PUBLICATIONS

Bienstock, D., "Coal-Oil Mixture Technology in the U.S.", *Fuel*, vol. 60, Sep., 1981, pp 851-864.

Veal, J. V., "Coal-Oil Dispersions-An Overview", *Fuel*, vol. 60, Sep., 1981, pp. 873-876.

Clayfield, E. J., "Colloil Manufacture and Application", *Fuel*, vol. 60, Sep., 1981, pp. 865-872.

*Primary Examiner*—William R. Dixon, Jr.
*Assistant Examiner*—Margaret B. Medley
*Attorney, Agent, or Firm*—David P. Yusko; John E. Miller; Larry W. Evans

[57] ABSTRACT

A fuel slurry consisting of a hydrocarbonaceous solid, oil and water effectively stabilized against settling of the solid by the addition of an aluminate, silicate, aluminosilicate or a combination of these compounds.

19 Claims, No Drawings

STABILIZATION OF COAL-OIL-WATER MIXTURES

BACKGROUND OF THE INVENTION

1. Field of the Invention

This invention relates to the stabilization of mixtures containing hydrocarbonaceous solids, oil and water. More specifically this invention relates to the stabilization of hydrocarbonaceous solid-oil-water mixtures by the addition of an aluminate, silicate, aluminosilicate or a combination of these compounds.

2. Description of the Prior Art

The major fuel employed by industrialized countries throughout the world is oil. Oil is feared to be a soon depleted resource. Since the early 1970's, the cost of oil has risen dramatically due to increased demand, price fixing cartels and increased exploration and production costs. In recent years there has been significant interest in replacement fuels for oil. Since coal is considerably less expensive and in abundant supply throughout the world, coal is expected to replace oil in many applications. However, such a conversion from oil to coal would require large expenditures of capital in order to replace existing oil burning systems with systems designed for coal.

An alternative to the replacement of oil systems is the use of coal-oil mixtures. Slurries of pulverized coal in oil exhibit handling characteristics similar to oil and can be transported, stored and burned in existing equipment designed for oil. A coal-oil mixture is less expensive than oil and can be utilized with no additional expenditures.

Coal-oil mixtures are not new; the first patent for coal-oil mixtures issued in 1879. However, since oil has traditionally been an abundant and inexpensive fuel, there has seldom existed a serious commercial interest for coal-oil mixtures, except during times of oil shortages.

In recent years, slurries of coal, heavy fuel oil and water have been investigated for use in industrial furnaces. However, at the elevated storage temperature necessary to reduce the oil viscosity, the coal tends to settle out of solution, giving the mixture a short life and questionable utility. Continuous mixing of the slurry maintains coal dispersement but is not usually possible or practical. Mechanical grinding or ball milling of the coal to effect a reduction of particle size, reduces the rate of precipitation, but is expensive and inefficient. The most feasible means of stabilizing such slurries has been through the use of additives.

Additives of varying chemistry and mechanisms have been tested over the years. Most proposed additives or stabilizers has been surface active agents with limited effectiveness. In recent years, the search for more effective additives have produced several potential additives yielding good stabilization of coal-oil-water mixtures. In spite of these recent advances, extensive research continues for new and better stabilizing agents.

SUMMARY OF THE INVENTION

A stabilized slurry consisting of a hydrocarbonaceous solid, fuel oil and water can be achieved by the addition of a stabilizing amount of at least one of an aluminate, a silicate, or an aluminosilicate. In a typical embodiment, a slurry of coal, heavy fuel oil and water can be effectively stabilized against settling by the addition of sodium aluminate.

DETAILED DESCRIPTION OF THE INVENTION

Any hydrocarbonaceous solid that can be mixed with a heavy fuel oil, water and a stabilizing amount of an aluminate, silicate, aluminosilicate or combinations thereof to form a stable slurry can be used in this invention.

Hydrocarbonaceous solid includes anthracite, bituminous, subbituminous and lignite coals, oil shale and peat. Hydrocarbonaceous solids with, some sulfur content are preferred. The hydrocarbonaceous solid is typically pulverized before being introduced into the slurry. The desired particle size is dependent on the specific application. The larger the particle size, the less expensive and sophisticated grinding technique will be required. However, large particle sizes may clog burner nozzles and tend to settle sooner. An average particle size no larger than 25 U.S. Standard mesh is suitable. However, smaller particle sizes are preferred and an average particle size of 200 mesh or smaller is most preferred.

The hydrocarbonaceous solid content of a typical slurry is between 40 and 80 wt %, based on the total weight of the slurry. Slurries containing less hydrocarbonaceous solid are viable, but since they do not maximize solid content, such slurries are usually not economically desireable. Slurries with a hydrocarbonaceous solid content approaching 80–90 wt % are also achievable, but they exhibit high viscosity and are generally not suitable for pipeline transmission, without extensive, expensive grinding to very fine particle sizes.

Any fuel oil sufficiently viscose which by reason of its viscosity suspends or slows the settling of particulate matter in contact with or blended into the fuel oil, is suitable for hydrocarbonaceous solid oil-water slurries. Typically, these oils will have a viscosity about equal to or greater than 20 centistokes at the temperature of the slurry. Heavy fuel oils are preferred.

Examples of such fuel oils include but are not limited to No. 4 fuel oil which is a liquid at room temperature and No. 5 and 6 fuel oils which are solids at room temperature and which require preheating before burning. The grades of fuel oil discussed in this specification are as described by A.S.T.M. D396-80(1980).

Water is added to the slurry for at least three reasons. It is effective in limiting some pollutants during combustion. It exhibits minor stabilizing effects in coal-oil mixtures. However, and most important, it interacts with the aluminate, silicate and aluminosilicate to promote a stable slurry. Water content in the slurry is typically kept under about 10 wt % of total slurry weight with a smaller percentage preferred, such as about 2–8 wt %. The water content of the slurry can be provided from either of two sources. All or part of the water content can come from water contained in the structure of the hydrocarbonaceous solid or water can be added to the slurry from an external source as the slurry is being mixed.

The hydrocarbonaceous solid-oil-water slurry is effectively stabilized by the addition of an aluminate, silicate, aluminosilicate or a combination of these compounds. An aluminate is preferred over a silicate, alumino silicate or a combination. These stabilizing agents are of the general formula:

$$M_aAl_bSi_cO_d \cdot xH_2O$$

where

M is a cation;

a is 1, 2, or 4;

b is 0, 1, 2 or 3;

c is 0, 1, 2, 3, or 4;

d is an integer 2 thru 11;

x is an integer 0 thru 9; and with the proviso that b and c are not simultaneously 0.

Examples of the types of compounds described by this formula include but are not limited to:

$NaAlO_2$;

$Na_2O \cdot Al_2O_3 \cdot 4SiO_2$;

$Na_2O \cdot Z(SiO_2)$, where Z=3, 4 or 5;

$Na_2Si_2O_5$;

$Na_2SiO_3$;

$Na_2SiO_3 \cdot 9H_2O$; and $Na_4SiO_4$.

The cation denoted by M in the above general formula is typically a metal cation, but nonmetal cations can also be used. Representative cations include lithium, sodium, potassium, rubidium, cesium, magnesium, calcium, strontium, barium, ammonium and the like. Single and divalent cations are preferred to cations of greater valence. The alkali metals and alkaline earth metals are more preferred, principally for reasons of economy and convenience. Sodium, calcium and potassium are the most preferred cations. The aluminate, silicate or aluminosilicate may also contain more than one cation, as in for example, $CaNa_2SiO_4$.

A stabilizing amount of the aluminate, silicate, aluminosilicate or combination thereof is mixed with the slurry. Typically these compounds are added in amounts equal to 0.01–5.0 wt % of the slurry, based on the total slurry weight and preferrably in amounts equal to 0.5–3.0 wt %.

While not wanting to be bound by theory, the aluminates, silicates and alumino silicates are believed to stabilize the slurry by interacting with the water to form a gel-like matrix which maintains the hydrocarbonaceous solid suspended in the oil. It is also theorized that these additives effect and maintain a reduction in particle size by attacking the sulfur sites in the hydrocarbonaceous solid and chemically comminuting the solid. Consequently these additives are expected to achieve best results when employed in a slurry containing a hydrocarbonaceous solid with some sulfur content.

The slurry can be mixed in any conventional mixing apparatus. The ingredients may be introduced into the slurry in any order. Typically, the slurry is constantly blended during the mixing process in order to achieve a good initial dispersion of the hydrocarbonaceous solid and the stabilizing agent in the slurry.

The stabilized slurry can be stored at any suitable temperature at which the fuel oil employed in the slurry is normally stored or handled as a liquid. For example, No. 6 fuel oil is a solid at room temperature and must be preheated to approximately 80° C. in order to liquify it before burning. A slurry containing No. 6 fuel oil can be stored at that elevated temperature.

The invention is illustrated in greater detail by the following examples.

SPECIFIC EMBODIMENTS

Control

Slurry Without a Stabilizing Agent

A coal-oil-water slurry consisting of 42 wt % bituminous coal with an average particle size of 200 U.S. Standard mesh, 52 wt % No. 6 fuel oil and 8 wt % distilled water was prepared. The materials were added in the above order and blended at room temperature with a low speed mixer. The mixture was then stored at 80° C. for 24 hours in a 6-inch tube. After one day the solid contents at the bottom of the tube increased by 14 wt %.

Example

Slurry With Stabilizing Agent

A coal-oil-water slurry consisting of 42 wt % bituminous coal with an average particle size of 200 U.S. Standard mesh, 52 wt % of No. 6 fuel oil and 8 wt % distilled water was prepared. The materials were added in the above order and blended at room temperature with a low speed mixer. Sodium aluminate in an amount equal to 1.5 wt % of the slurry was added and the slurry reblended. The mixture was stored at 80° C. for 24 hours in a 6-inch tube. After one day the increase solid contents at the bottom of the tube was only 2 wt %.

The above examples illustrate the effect of the stabilizing agent. After 24 hours, considerably less coal precipitated from the slurry containing the stabilizing agent than precipitated from the slurry without the stabilizing agent.

What is claimed is:

1. A hydrocarbonaceous solid-oil-water slurry containing at least 40 weight percent oil and effectively stabilized against settling of the solid by the addition of a stabilizing amount of an aluminate.

2. The slurry of claim 1 comprising, in wt % based on the total weight of the slurry between about:

(a) 30 wt % and 60 wt % of particulate hydrocarbonaceous solid;

(b) 40 wt % and 70 wt % of oil;

(c) 1 wt % and 8 wt % of water; and (d) 0.01 wt % and 10.0 wt % of the aluminate.

3. The slurry of claim 1 comprising, in wt percent based on the total weight of the slurry between about:

(a) 35 wt percent and 60 wt percent of particulate hydrocarbonaceous solid;

(b) 40 wt percent and 65 wt percent of oil;

(c) 2 wt percent and 8 wt percent of water;

(d) 0.5 wt percent and 3 wt percent of the aluminate.

4. The slurry of claim 1 comprising about:

(a) 39.5 wt % of particulate hydrocarbonaceous solid;

(b) 51.2 wt % of oil;

(c) 7.8 wt % of water; and (d) 1.5 wt % of the aluminate.

5. The slurry of claim 1 in which the average particle size is smaller than or equal to approximately 25 U.S. standard mesh.

6. The slurry of claim 5 in which the average particle size of the hydrocarbonaceous solid is about 200 U.S. Standard mesh.

7. The slurry of claim 1 in which the hydrocarbonaceous solid is one of or a combination of anthracite, bituminous, subbituminous or lignite coals, oil shale and peat.

8. The slurry of claim 7 in which the hydrocarbonaceous solid is bituminous coal.

9. The slurry of claim 1 in which the oil is any fuel oil having a viscosity about equal to or greater than 20 centistokes at the temperature of the slurry.

10. The slurry of claim 1, in which the oil is one of grade No. 4, No. 5 or No. 6 fuel oils as specified by A.S.T.M. D396-80(1980).

11. The slurry of claim 10, in which the oil is No. 6 fuel oil.

12. The slurry of claim 11, having a temperature of approximately 80° C.

13. The slurry of claim 1 in which the aluminate is of the formula:

$$M_aAl_bSi_cO_d \cdot xH_2O$$

where

M is a cation;

a is 1, 2 or 4;

b is 1, 2 or 3;

c is 0;

d is an integer 2 thru 11; and x is an integer 0 thru 9.

14. The slurry of claim 13, where M is a metal cation.

15. The slurry of claim 13, where M is an alkali metal or an alkaline earth metal.

16. The slurry of claim 13 where M is one of lithium, sodium, potassium, rubidium, cesium, magnesium, calcium, strontium, barium or ammonium.

17. The slurry of claim 13 where M is one of sodium, calcium or potassium.

18. The slurry of claim 1 where the aluminate is sodium aluminate.

19. The slurry of claim 1 comprising about:

(a) 39.5 wt % particulate bituminous coal, having an average particle size of about 200 U.S. Standard mesh;

(b) 51.2 wt % of A.S.T.M. D396-80(1980) Grade No. 6 fuel oil;

(c) 7.8 wt % of water; and (d) 1.5 wt % of sodium aluminate.

* * * * *